US009054475B2

(12) United States Patent
Hoffman

(10) Patent No.: US 9,054,475 B2
(45) Date of Patent: Jun. 9, 2015

(54) ELECTRICAL BRACKETS FOR FLUORESCENT BULB

(71) Applicant: Ervin Hoffman, Brooklyn, NY (US)

(72) Inventor: Ervin Hoffman, Brooklyn, NY (US)

( * ) Notice: Subject to any disclaimer, the term of this patent is extended or adjusted under 35 U.S.C. 154(b) by 0 days.

(21) Appl. No.: 13/732,359

(22) Filed: Dec. 31, 2012

(65) Prior Publication Data

US 2013/0288499 A1 Oct. 31, 2013

Related U.S. Application Data

(60) Provisional application No. 61/582,338, filed on Dec. 31, 2011, provisional application No. 61/587,679, filed on Jan. 18, 2012.

(51) Int. Cl.
*H01R 33/08* (2006.01)

(52) U.S. Cl.
CPC ..... *H01R 33/0836* (2013.01); *H01R 33/0845* (2013.01)

(58) Field of Classification Search
USPC ..... 439/239, 254, 246, 857, 226, 752, 357
See application file for complete search history.

(56) References Cited

U.S. PATENT DOCUMENTS

| | | | | |
|---|---|---|---|---|
| 8,282,408 | B1 * | 10/2012 | Chou et al. | 439/226 |
| 8,317,529 | B2 * | 11/2012 | Katano | 439/251 |
| 2007/0066112 | A1 * | 3/2007 | Tufano et al. | 439/239 |
| 2010/0015832 | A1 * | 1/2010 | Tufano et al. | 439/239 |
| 2011/0104923 | A1 * | 5/2011 | Tufano et al. | 439/239 |

* cited by examiner

*Primary Examiner* — Jean F Duverne
(74) *Attorney, Agent, or Firm* — Israel Nissenbaum; Yitzy Nissenbaum

(57) ABSTRACT

A pair of brackets for a multiple pin fluorescent bulb. A first bracket has two horizontal apertures on an inside face of the bracket and each bracket is sized and spaced from the other to permit insertion engagement and holding of two end pins of one end of the fluorescent bulb. The horizontal apertures permit the other end of the bulb to be vertically moved for engagement with an opposite facing bracket which has two vertical slots with a lower end open access. The vertical slots permit two other horizontally aligned end pins of the fluorescent bulb to be inserted therein by an upward vertical movement. Electrically conductive spring like metal members extend into a path of the vertical slots such that they electrically engage and hold the opposite end pins of the fluorescent bulb. A releasing element pushed the spring like members apart for pin and bulb removal.

3 Claims, 1 Drawing Sheet

ELECTRICAL BRACKETS FOR FLUORESCENT BULB

FIELD OF THE INVENTION

This invention relates to electrical brackets for long tube type fluorescent bulbs and particularly to such bulbs having multiple end pin connectors such as the ubiquitous 40 watt fluorescent bulbs with double end pin connection elements.

BACKGROUND

The design of standard fluorescent bulbs has not changed for decades, not have the brackets and electrical fixtures for such bulbs changed in any significant manner. A typical and standard four foot fluorescent bulb has two pairs of aligned pin connectors on the two ends thereof. Other multiple pin fluorescent bulbs are of various sizes and include 14, 15, 20 and 40 and watt usage (the common four foot bulbs are generally 40 watts). Electrical brackets for such bulbs come in pairs usually fixedly arranged on a fixture. Each one of the members of the bracket pair are identically configured and facingly positioned on the fixtures at a distance slightly larger than the length of a bulb and less than the bulb length with the pins (i.e., the pins are retained within the brackets). Each bracket has an open single vertical slot, an internal central vertical open insulative track and an outer open circular track channel with retained spring-like metal elements, which physically and electrically engage the bulb pins. Engagement of the pins with the metal elements effects an electrical connection to a power source to thereby light the bulb.

Installing a fluorescent bulb having multiple pins into the fixture brackets requires an initial vertical alignment of the pins of a first end of a fluorescent bulb and the vertical slot. The pins of one end of the bulb is pushed into the single vertical slot, with full insertion of both pins into the vertical slot and central track. The second end of the bulb is then aligned (sequence of alignment and insertion may vary and may even be simultaneous) with the vertical slot of a second facing bracket at the other end of the fixture and with a similar full insertion of both pins into the vertical slot and vertical channel, while holding and maintaining the first end in position. Full insertion of each pair of pins enables both pins to be positioned in the outer open circular track. The bulb is then rotated around an axis passing through both brackets, with the pins moving in the outer open circular track into engagement with the spring-like metal elements to effect an electrical connection and lighting of the bulb. Many problems often manifest themselves with such procedure especially with fixtures having multiple sets of paired brackets for use with multiple bulbs, with restricted access and with ceiling fixtures requiring arm extension installation. Failure to fully insert the pins may result in damage to the pins when the bulb is rotated with the pins outside of the circular track or if one of the pins is actually outside of the bracket.

SUMMARY OF THE INVENTION

It is an object of the present invention to modify the structure of the existing brackets to eliminate the currently used rotation engagement and activation.

It is a further object of the present invention to provide such structure with a simple positive engagement of a first pair of pins on one end of the fluorescent bulb and a simple linear movement of the second pair of pins and fluorescent bulb end to complete an electrical connection.

Generally the present invention comprises a pair of electrical engagement brackets for a multiple pin fluorescent bulb such as the bulbs with 14, 15, 20 and 40 watt usage with a four foot bulb using 40 watts. In a first embodiment, a first bracket is configured with two horizontal apertures on the inside face of the bracket, each dimensionally sized and spaced from each other to permit insertion engagement and holding of the two end pins of one end of the fluorescent bulb. The apertures are sized to permit the other end of the bulb to be vertically moved for engagement with an opposite facing bracket. The opposite facing bracket is configured with two vertical slots with a lower end open access. The vertical slots are positioned and configured to permit the two other end pins of the fluorescent bulb to be inserted therein by an upward vertical movement. Electrically conductive spring like metal members extend into the path of the vertical slots such that they holdingly and electrically engage the opposite end pins of the fluorescent bulb whereby the bulb extend along an axis parallel to the fixture base of the brackets.

The slotted bracket comprises an external accessible disengaging member configured to effect disengagement of the second pair of fluorescent end-pins from the spring like metal members which hold the pins in the slots. This disengagement permits the end of the fluorescent bulb to be removed from the vertical slots and the fluorescent bulb to be removable from the fixture such as for replacement.

In a preferred embodiment the apertured bracket is provided with a facing button or pin, which effects electrical contact within the bracket. The button is depressed and full electrical connection is made when the fluorescent bulb installation is complete. Until such time no end of the fluorescent becomes live with an exposed electrical contact.

In a second embodiment, both brackets are, for economical considerations, identically configured with upward insertion slots, with the pins on both ends of the fluorescent bulb being held by the interior spring like metal members, which also provide the electrical contact. In this embodiment only one of the brackets need be provided with the release mechanism to release the pins since once the pins of the first side are released and the pins are removed from the bracket the pin of the other side can simply be pulled from the bracket to remove the fluorescent bulb from the fixture.

The above and other objects, features and advantages of the present invention will become more evident from the figures which:

SHORT DESCRIPTION OF THE DRAWINGS

DETAILED DESCRIPTION

Figure 2:
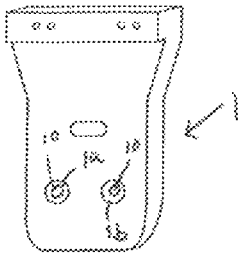
FIG. 2 is a view of a first embodiment of the bracket of the present invention with pin insertion apertures and electrical connection activation element.
Figure 5:
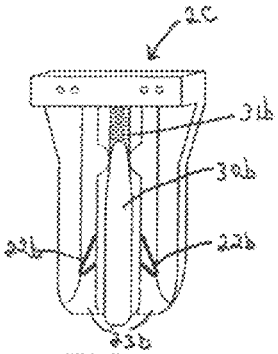
Figure 6:
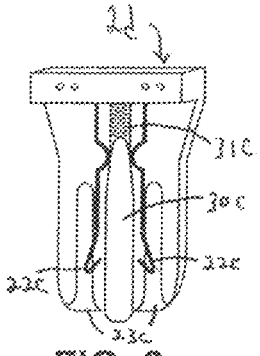
Figure 7:
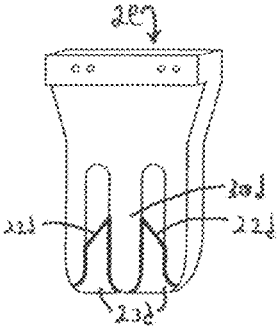
FIG. 7 is a view of the slotted bracket, from the slide insertion side, for the fluorescent bulb pins.
Figure 8:
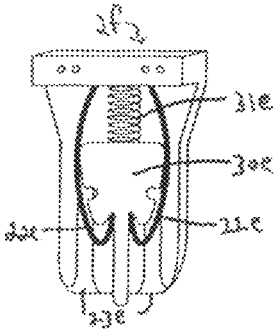
Figure 1:
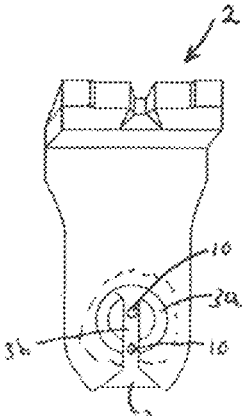
FIG. 1 Prior Art
FIG. 1 is a depiction of a single prior art fluorescent bulb fixture bracket from the pin insertion side.
Figure 9:
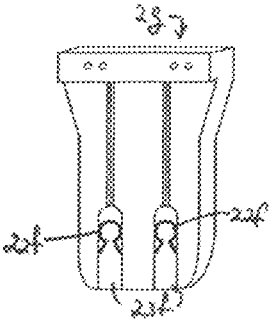
FIG. 9 is a view of an embodiment adaptable to both slotted and aperture insertion and is of simplified design.

The Figures provide a contrast between the prior art bracket of FIG. 1 requiring a vertically aligned pin insertion and twisting, with the direct horizontal aperture insertion of the bracket in FIG. 2 and the horizontal upward sliding insertion in the bracket of FIG. 7. FIGS. 3-6 and 8 show various electrical contacts within the bracket and plunger configurations, which permit disengagement of the inserted pin from the spring-loaded supporting and holding metal electrical contact elements for bulb removal. FIG. 9 shows an apertured bracket with sliding slides of simplified structure.

Figure 10:
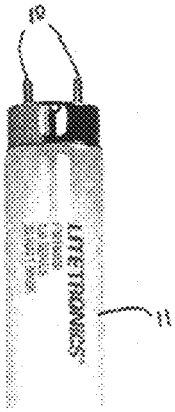
FIG. 10 is an end view of a typical fluorescent bulb with a pair of pin connectors with an identical opposite end.

With more detailed reference to the drawings, FIG. 1 depicts a prior art fluorescent light bracket 2 for use with a fluorescent light bulb 11 with end connector pins 10 such as shown in FIG. 10 (with identical end connectors on both ends of the bulb 11 and identically aligned with each other). A second fluorescent identical light bracket is spaced from the first and facing the first. The spacing between the facing brackets is that of the bulb less the length of the pins 10 with the pins being fitted into the brackets to effect holding of the bulb and electrical connection. As described above, during placement in prior art brackets 2, the end connectors 10 are vertically aligned in pairs and inserted into single receptor 3 of bracket 2 of each bracket as shown. Pins 10 are initially positioned through vertical space 3*b* into circular track 3*a* and then rotated into contact with electrical contacts within the bracket, to effect a light operative connection.

Figure 3:
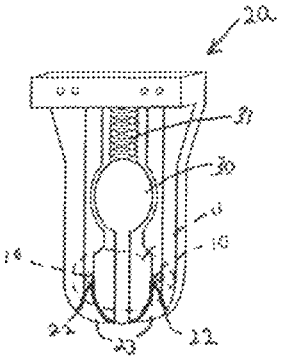
FIGS. 3-6 and 8 are cross section views of pin sliding slotted brackets of the present invention with various embodiments of electrical engagement elements with operation releasing plungers.
Figure 4:
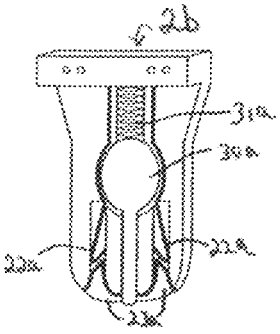

FIG. 2 shows an end bracket 1 of an embodiment of the he present invention adapted to hold pins 10 of fluorescent bulb 11 with a substantially horizontal sliding placement of pins 10 into apertures 1*a* and 1*b* which effects both a holding and electrical connection. The other end of bulb 11 is fitted into one of bracket 2*a*-2*g* embodiments shown in FIGS. 3-9 respectively. While the pins 10 are held within apertures 1*a* and 1*b*, the identical pins 10 of the other side of bulb 11 are positioned horizontally, as opposed to the vertical alignment of the prior art and are moved in horizontal alignment vertically upward with pins 10 being separately fitted into slot pairs or wide sections 23-23*f* of brackets 3-9 respectively into electrical retention contact with spring resilient conductive metal contact terminal pairs 22-22*f*, which have bevels and hook shaped configurations in FIGS. 3-8 and a circle support in FIG. 9 respectively, to effect both position holding and electrical connection of the inserted bulbs 11. FIG. 3, shows in dotted lines the representative position of the bulb 11 and pins 10. Pins 10 push terminal pairs 22 apart and are then seated into and held by the upper portions of terminal pairs 22 The bulbs 11 and pins 10 are removed from the bracket with pressure against spring loaded springs 31*a*, 31*b*, 31*c* and 31*e* and pushing of removal elements 30-30*f* respectively to move elements progressively larger, which spread the hook of terminals 22 apart to permit removal of pins 10 and bulb 11 from the respective brackets. Embodiments of FIGS. 4-8 are similarly operative, with the embodiment of FIG. 9 showing use of a spring like open circle terminals 22*f* to hold pins 10 and effect electrical connection. In this latter embodiment simple downward pulling of the bulb 11 effects release of pins 10 from terminals 22*f* without need of a separate removal member.

With bulb emplacement or replacement, bulb end pins 10 are placed first into bracket embodiment of FIG. 2 and the opposite end pins 10 are removed first from the embodiments of FIGS. 3-9. In lieu of the bracket 2 being paired with any of the bracket embodiments of FIGS. 3-9, the brackets 3-9 may be paired in any arrangement to affect similar electrical bulb connection with simple upward direct placement and downward direction removal without rotation of the prior art and its concomitant possible misalignment.

What is claimed is:

1. A pair of electrical engagement brackets for an elongated multiple pin fluorescent bulb having first and second pairs of terminal pins on opposite ends thereof with a first bracket comprising two horizontal apertures on an inside face of the bracket, each bracket being dimensionally sized and spaced from the other to permit insertion engagement and holding of two end pins of one end of the fluorescent bulb, the horizontal apertures are each sized to permit the other end of the bulb with two other end pins in a horizontal position relative to each other to be vertically moved for engagement of the two other end pins with an opposite facing bracket end, with the opposite facing bracket having one of a slot wide enough to accommodate insertion therethrough of the horizontally positioned pins and two vertical slots with a lower end open access, wherein the vertical slots are positioned and sized to permit the two other horizontally positioned end pins of the fluorescent bulb to be inserted therein by an upward vertical movement, with electrically conductive spring like metal members extending into a path of the wide slot and vertical slots such that the electrically conductive spring like metal members holdingly and electrically engage the opposite end pins of the fluorescent bulb whereby the bulb extends along an axis parallel to the fixture base of the brackets.

2. The brackets of claim 1 wherein the slotted bracket comprises an externally accessible disengaging member configured to effect disengagement of the second pair of fluorescent end-pins from the spring like metal members which hold the pins in the slots with the disengagement permitting the end of the fluorescent bulb to be removed from the wide slot and vertical slots and the fluorescent bulb to be removable from the fixture.

3. A pair of electrical engagement brackets for an elongated multiple pin fluorescent bulb having first and second pairs of terminal pins on opposite ends thereof with each bracket comprising one of a slot wide enough to accommodate insertion therethrough of a pair of horizontally positioned pins and two vertical slots with a lower end open access, wherein the vertical slots are positioned and sized to permit two horizontally positioned end pins of the fluorescent bulb to be inserted therein by an upward vertical movement, with electrically conductive spring like metal members extending into a path of the wide slot and vertical slots such that the electrically conductive spring like metal members holdingly and electrically engage the opposite end pins of the fluorescent bulb whereby the bulb extends along an axis parallel to the fixture base of the brackets.

* * * * *